US010228135B2

(12) United States Patent
Stoia et al.

(10) Patent No.: US 10,228,135 B2
(45) Date of Patent: Mar. 12, 2019

(54) COMBUSTION LINER COOLING

(71) Applicant: General Electric Company, Schenectady, NY (US)

(72) Inventors: Lucas John Stoia, Taylors, SC (US); Ronnie Ray Pentecost, Travelers Rest, SC (US); Jonathan Hale Kegley, Greer, SC (US)

(73) Assignee: General Electric Company, Schenectady, NY (US)

( * ) Notice: Subject to any disclaimer, the term of this patent is extended or adjusted under 35 U.S.C. 154(b) by 293 days.

(21) Appl. No.: 15/070,047

(22) Filed: Mar. 15, 2016

(65) Prior Publication Data

US 2017/0268778 A1 Sep. 21, 2017

(51) Int. Cl.

| | |
|---|---|
| ***F23R 3/00*** | (2006.01) |
| ***F23R 3/04*** | (2006.01) |
| ***F23R 3/28*** | (2006.01) |
| ***F01D 9/02*** | (2006.01) |
| ***F23R 3/34*** | (2006.01) |
| ***F23R 3/46*** | (2006.01) |

(52) U.S. Cl.

CPC ..... *F23R 3/005* (2013.01); *F01D 9/023* (2013.01); *F23R 3/04* (2013.01); *F23R 3/283* (2013.01); *F23R 3/346* (2013.01); *F23R 3/46* (2013.01)

(58) Field of Classification Search

CPC .. F01D 9/023; F23R 3/00; F23R 3/002; F23R 3/005; F23R 3/02; F23R 3/46; F23R 3/283

See application file for complete search history.

(56) References Cited

U.S. PATENT DOCUMENTS

| | | | | |
|---|---|---|---|---|
| 6,681,578 | B1 | 1/2004 | Bunker | |
| 7,104,067 | B2 | 9/2006 | Bunker | |
| 8,646,276 | B2 | 2/2014 | Davis, Jr. et al. | |
| 8,677,759 | B2 | 3/2014 | Kaleeswaran et al. | |
| 8,966,903 | B2 | 3/2015 | Bobba et al. | |
| 2010/0300107 | A1 | 12/2010 | Barton et al. | |
| 2011/0110761 | A1* | 5/2011 | Haehnle | F01D 9/023 415/115 |

(Continued)

FOREIGN PATENT DOCUMENTS

JP H11-257660 A 9/1999

OTHER PUBLICATIONS

Extended European Search Report and Opinion issued in connection with corresponding EP Application No. 17160546.2 dated Aug. 14, 2017.

*Primary Examiner* — Craig Kim
(74) *Attorney, Agent, or Firm* — Dority & Manning, P.A.

(57) ABSTRACT

The present disclosure is directed to a combustor including an annularly shaped liner that at least partially defines a hot gas path of the combustor and a flow sleeve that circumferentially surrounds at least a portion of the liner. The flow sleeve is radially spaced from the liner to form a cooling flow annulus therebetween. A plurality of fuel injector assemblies circumferentially spaced about the flow sleeve and each fuel injector assembly extends radially through the flow sleeve, the cooling flow annulus and the liner. A first portion of the flow sleeve defined between a first pair of circumferentially adjacent fuel injector assemblies of the plurality of fuel injector assemblies bulges radially outwardly with respect to an outer surface of the liner so as to enlarge a flow volume of the cooling flow annulus.

19 Claims, 3 Drawing Sheets

(56) References Cited

U.S. PATENT DOCUMENTS

| | | | | |
|---|---|---|---|---|
| 2013/0074505 | A1 | 3/2013 | Toronto et al. | |
| 2014/0260277 | A1 * | 9/2014 | DiCintio | F23R 3/005 60/746 |
| 2016/0047317 | A1 | 2/2016 | Willis et al. | |

* cited by examiner

COMBUSTION LINER COOLING

FIELD OF THE TECHNOLOGY

The subject matter disclosed herein relates to a combustor for a gas turbine. More specifically, the disclosure is directed to cooling a liner of the gas turbine combustor.

BACKGROUND

Gas turbines usually burn hydrocarbon fuels and produce air polluting emissions such as oxides of nitrogen (NOx) and carbon monoxide (CO). Oxidization of molecular nitrogen in the gas turbine depends upon the temperature of gas located in a combustor, as well as the residence time for reactants located in the highest temperature regions within the combustor. Thus, the amount of NOx produced by the gas turbine may be reduced by either maintaining the combustor temperature below a temperature at which NOx is produced, or by limiting the residence time of the reactant in the combustor.

One approach for controlling the temperature of the combustor involves pre-mixing fuel and air to create a lean fuel-air mixture prior to combustion. This approach may include the axial staging of fuel injection where a first fuel-air mixture is injected and ignited at a first or primary combustion zone of the combustor to produce a main flow of high energy combustion gases, and where a second fuel-air mixture is injected into and mixed with the main flow of high energy combustion gases via a plurality of radially oriented and circumferentially spaced fuel injectors or axially staged fuel injectors positioned downstream from the primary combustion zone. Axially staged injection increases the likelihood of complete combustion of available fuel, which in turn reduces the air polluting emissions.

During operation of the combustor, it is necessary to cool one or more liners or ducts that form a combustion chamber and/or a hot gas path through the combustor. Liner cooling is typically achieved by routing compressed air through a cooling flow annulus or flow passage defined between the liner and a flow sleeve and/or an impingement sleeve that surrounds the liner. However, in particular configurations, the axially staged fuel injectors extend through the flow sleeve, the cooling flow annulus and the liner, thereby disrupting the cooling flow and/or limiting cooling flow volume through the cooling flow annulus. As a result, cooling effectiveness of the compressed air may be reduced and undesirable pressure losses may occur within the combustor.

BRIEF DESCRIPTION OF THE TECHNOLOGY

Aspects and advantages are set forth below in the following description, or may be obvious from the description, or may be learned through practice.

One embodiment of the present disclosure is directed to a combustor. The combustor includes an annularly shaped liner that at least partially defines a hot gas path of the combustor and a flow sleeve that circumferentially surrounds at least a portion of the liner where the flow sleeve is radially spaced from the liner to form a cooling flow annulus therebetween. A plurality of fuel injector assemblies is circumferentially spaced about the flow sleeve. Each fuel injector assembly extends radially through the flow sleeve, the cooling flow annulus and the liner. A first portion of the flow sleeve defined between a first pair of circumferentially adjacent fuel injector assemblies of the plurality of fuel injector assemblies bulges radially outwardly with respect to an outer surface of the liner so as to enlarge a flow volume of the cooling flow annulus.

Another embodiment of the present disclosure is directed to a combustor. The combustor includes an annularly shaped liner that at least partially defines a hot gas path of the combustor and a flow sleeve that circumferentially surrounds at least a portion of the liner. The flow sleeve is radially spaced from the liner to form a cooling flow annulus therebetween. The flow sleeve has an upstream end and a downstream end that is axially spaced from the upstream end with respect to an axial centerline of the liner. A first portion of the flow sleeve is defined between the upstream end and the downstream end and bulges radially outwardly with respect to an outer surface of the liner so as to increase a flow volume of the cooling flow annulus.

Another embodiment includes a gas turbine engine. The gas turbine engine includes a compressor, a turbine and a combustor disposed downstream from the compressor and upstream from the turbine. The combustor includes an annularly shaped liner that at least partially defines a hot gas path and a flow sleeve that circumferentially surrounds at least a portion of the liner. The flow sleeve is radially spaced from the liner to form a cooling flow annulus therebetween. A first portion of the flow sleeve is defined between the upstream end and the downstream end and bulges radially outwardly with respect to an outer surface of the liner so as to increase a flow volume of the cooling flow annulus.

Those of ordinary skill in the art will better appreciate the features and aspects of such embodiments, and others, upon review of the specification.

BRIEF DESCRIPTION OF THE DRAWINGS

A full and enabling disclosure of the of various embodiments, including the best mode thereof to one skilled in the art, is set forth more particularly in the remainder of the specification, including reference to the accompanying figures, in which.

DETAILED DESCRIPTION

Figure 1:
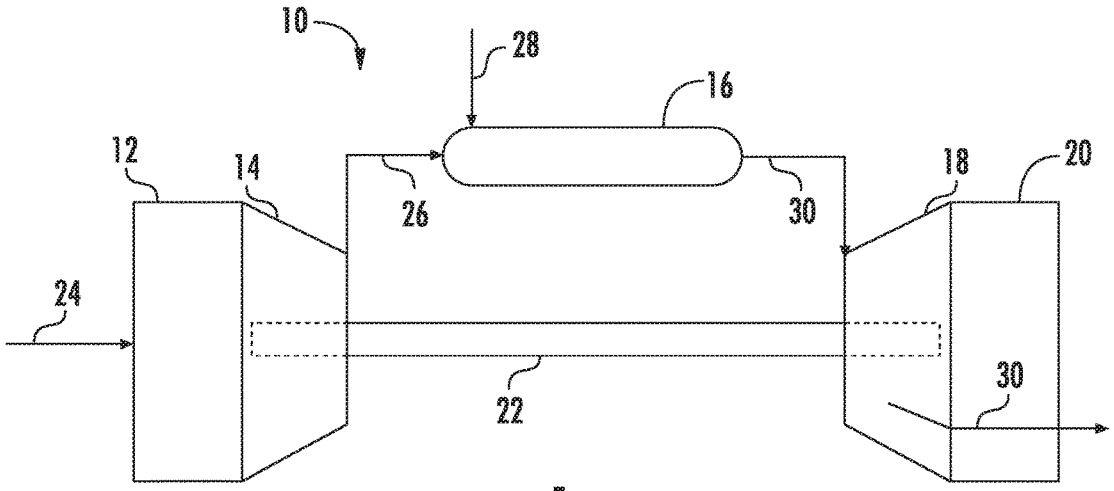
FIG. 1 is a functional block diagram of an exemplary gas turbine that may incorporate various embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component and the term "circumferentially" refers to the relative direction that extends around the axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a combustor for a land based power generating gas turbine combustor for purposes of illustration, one of ordinary skill in the art will readily appreciate that embodiments of the present disclosure may be applied to any style or type of combustor for a turbomachine and are not limited to combustors or combustion systems for land based power generating gas turbines unless specifically recited in the claims.

Referring now to the drawings, FIG. 1 illustrates a schematic diagram of an exemplary gas turbine 10. The gas turbine 10 generally includes an inlet section 12, a compressor 14 disposed downstream of the inlet section 12, at least one combustor 16 disposed downstream of the compressor 14, a turbine 18 disposed downstream of the combustor 16 and an exhaust section 20 disposed downstream of the turbine 18. Additionally, the gas turbine 10 may include one or more shafts 22 that couple the compressor 14 to the turbine 18.

During operation, air 24 flows through the inlet section 12 and into the compressor 14 where the air 24 is progressively compressed, thus providing compressed air 26 to the combustor 16. At least a portion of the compressed air 26 is mixed with a fuel 28 within the combustor 16 and burned to produce combustion gases 30. The combustion gases 30 flow from the combustor 16 into the turbine 18, wherein energy (kinetic and/or thermal) is transferred from the combustion gases 30 to rotor blades (not shown), thus causing shaft 22 to rotate. The mechanical rotational energy may then be used for various purposes such as to power the compressor 14 and/or to generate electricity. The combustion gases 30 exiting the turbine 18 may then be exhausted from the gas turbine 10 via the exhaust section 20.

Figure 2:
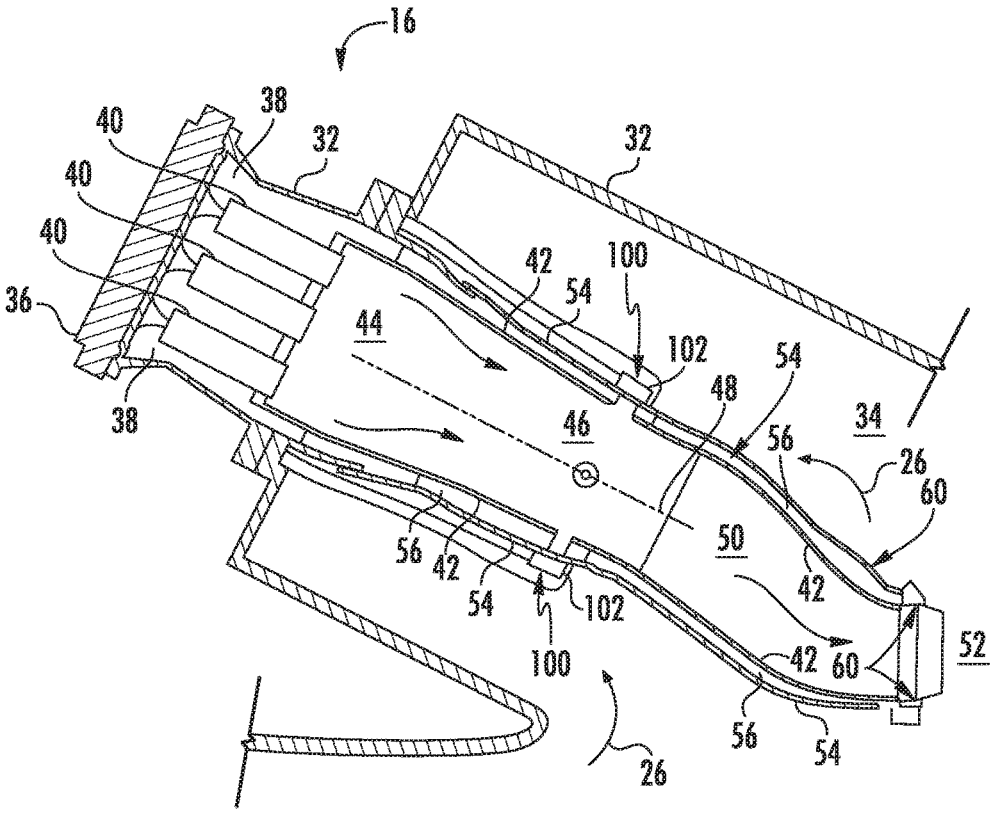
FIG. 2 is a simplified cross-section side view of an exemplary combustor as may incorporate various embodiments of the present disclosure.

As shown in FIG. 2, the combustor 16 may be at least partially surrounded an outer casing 32 such as a compressor discharge casing. The outer casing 32 may at least partially define a high pressure plenum 34 that at least partially surrounds various components of the combustor 16. The high pressure plenum 34 may be in fluid communication with the compressor 14 (FIG. 1) so as to receive the compressed air 26 therefrom. An end cover 36 may be coupled to the outer casing 32. In particular embodiments, the outer casing 32 and the end cover 36 may at least partially define a head end volume or portion 38 of the combustor 16. In particular embodiments, the head end portion 38 is in fluid communication with the high pressure plenum 34 and/or the compressor 14.

Fuel nozzles 40 extend axially downstream from the end cover 36. One or more annularly shaped liners or ducts 42 may at least partially define a primary or first combustion or reaction zone 44 for combusting the first fuel-air mixture and/or may at least partially define a secondary combustion or reaction zone 46 formed axially downstream from the first combustion zone 44 with respect to an axial centerline 48 of the combustor 16. The liner 42 at least partially defines a hot gas path 50 from the primary fuel nozzle(s) 40 to an inlet 52 of the turbine 18 (FIG. 1). In at least one embodiment, the liner 42 may be formed so as to include a tapering or transition portion. In particular embodiments, the liner 42 may be formed from a singular or continuous body.

In at least one embodiment, the combustor 16 includes an axially staged fuel injection system 100. The axially staged fuel injection system 100 includes at least one fuel injector assembly 102 axially staged or spaced from the primary fuel nozzle(s) 40 with respect to axial centerline 48. The fuel injector assembly 102 is disposed downstream of the primary fuel nozzle(s) 40 and upstream of the inlet 52 to the turbine 18. It is contemplated that a number of fuel injector assemblies 102 (including two, three, four, five, or more fuel injector assemblies 102) may be used in a single combustor 16.

In the case of more than one fuel injector assembly 102, the fuel injector assemblies 102 may be equally spaced circumferentially about the perimeter of the liner 42 with respect to circumferential direction 104, or may be spaced at some other spacing to accommodate struts or other casing components. For simplicity, the axially staged fuel injection system 100 is referred to, and illustrated herein, as having fuel injector assemblies 102 in a single stage, or common axial plane, downstream of the primary combustion zone 44. However, it is contemplated that the axially staged fuel injection system 100 may include two axially spaced stages of fuel injector assemblies 102. For example, a first set of fuel injector assemblies 102 and a second set of fuel injector assemblies 102 may be axially spaced from one another along the liner(s) 42.

Each fuel injector assembly 102 extends through liner 42 and is in fluid communication with the hot gas path 50. In various embodiments each fuel injector assembly 102 also extends through a flow or impingement sleeve 54 that at least partially surrounds liner 42. In this configuration, the flow sleeve 54 and liner 42 define an annular flow passage or cooling flow annulus 56 therebetween. The cooling flow annulus 56 at least partially defines a flow path between the high pressure plenum 34 and the head end portion 38 of the combustor 16.

Figure 3:
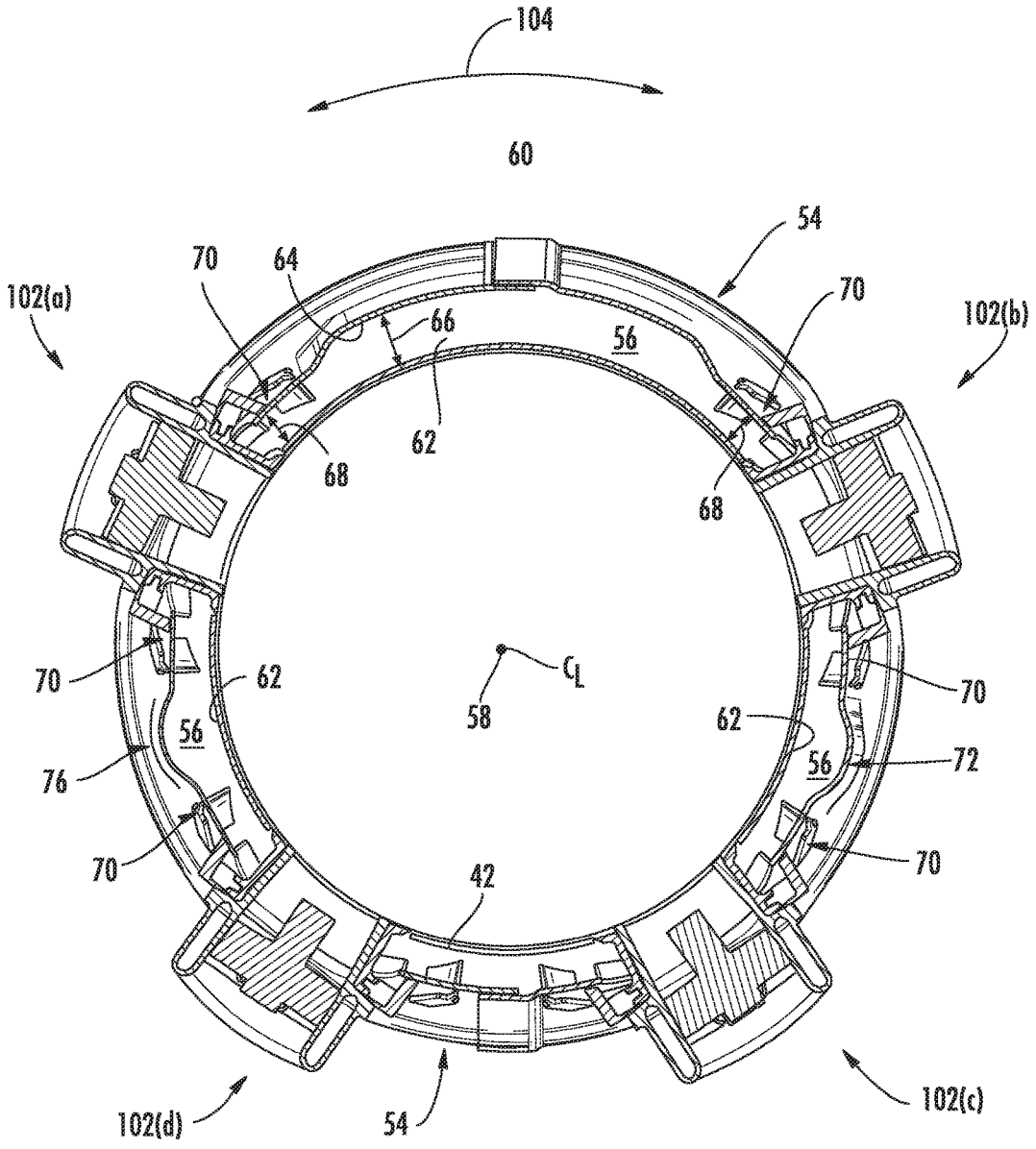
FIG. 3 is an upstream cross-sectional view of a portion of a combustor including a liner, a flow sleeve and fuel injector assemblies according to at least one aspect of the present disclosure.
Figure 4:
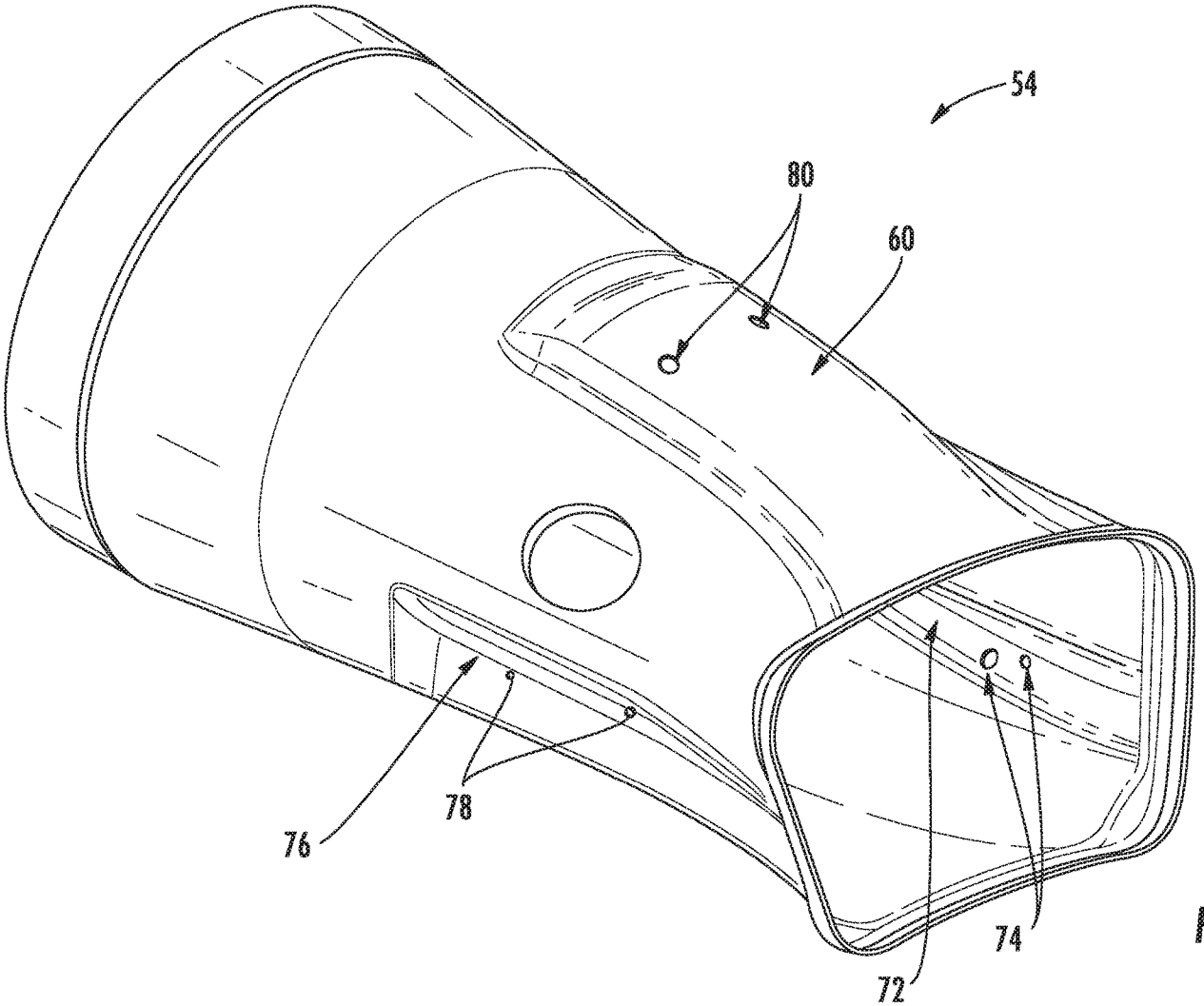
FIG. 4 is perspective view of an exemplary flow sleeve according to at least one embodiment of the present disclosure.

FIG. 3 provides an upstream cross sectional view of the liner 42 and the flow sleeve 54 with four fuel injector assemblies 102(*a-d*) of the plurality of fuel injector assemblies 102 mounted thereto according to at least one embodiment of the present disclosure. FIG. 4 provides a perspective view of an exemplary flow sleeve 54 according to at least one embodiment of the present disclosure with the fuel injector assemblies 102 removed. In at least one embodiment, as shown in FIG. 3, the flow sleeve 54 circumferentially surrounds at least a portion of the liner 42. The flow sleeve 54 is radially spaced from the liner 42 to form the cooling flow annulus 56 therebetween.

In one exemplary embodiment, as shown in FIG. 3, the plurality of the fuel injector assemblies 102 includes four fuel injector assemblies 102(*a*), 102(*b*), 102(*c*) and 102(*d*) circumferentially spaced about the flow sleeve 54. As shown in FIG. 3, each fuel injector assembly 102(*a*), 102(*b*), 102(*c*) and 102(*d*) extends radially through the flow sleeve 54, the cooling flow annulus 56 and the liner 42 with respect to axial centerline 58 of the liner 42. As shown in FIG. 2, the cooling flow annulus 56 defines a flow path between the high pressure plenum 34 and the head end portion 38 of the combustor 16.

In at least one embodiment, as shown in FIGS. 2 and 3, a first portion 60 of the flow sleeve 54 that is defined between a first pair of circumferentially adjacent fuel injector assemblies 102(*a*) and 102(*b*) (FIG. 3) of the plurality of fuel injector assemblies 102 bulges or protrudes radially outwardly with respect to an outer surface 62 of the liner 42 so as to enlarge the flow volume of the cooling flow annulus 56. In other words, an inner surface 64 of the flow sleeve 54 along the first portion 60 is at a radial distance 66 from the outer surface 62 of the liner 42 that is greater than a radial distance 68 between the outer surface 62 of the liner 42 and the inner surface 64 of the flow sleeve 54 at circumferentially adjacent or non-bulging portion 70 of the flow sleeve 54 as measured in a common or the same radial plane with respect to axial centerline 58. As such, a cross sectional flow area of the cooling flow annulus 56 along the protrusion or the first portion 60 is greater than a cross sectional flow area of the cooling flow annulus 56 along the non-bulging portions 70 along the same or a common radial plane with respect to axial centerline 58.

In particular embodiments, the cross sectional flow area created by the bulge along the first portion 60 of the flow sleeve 54 is equivalent to or substantially equivalent to a cross sectional area of portions of the circumferentially adjacent fuel injector assemblies 102(*a*) and 102(*b*) disposed within the cooling flow annulus 56. The first portion 60 or bulging portion of the flow sleeve 54 restores overall cross sectional flow area within the cooling flow annulus 56 that may be lost due to the size of the fuel injector assemblies 102(*a*) and 102(*b*), particularly in the same radial and/or circumferential plane as the circumferentially adjacent fuel injector assemblies 102(*a*) and 102(*b*). As a result, pressure drop within the cooling flow annulus 56 and/or between the high pressure plenum 34 and the head end volume or portion 38 of the combustor may be reduced.

In at least one embodiment, as shown in FIG. 3, a second portion 72 of the flow sleeve 54 that is defined between a second pair of circumferentially adjacent fuel injector assemblies 102(*b*) and 102(*c*) of the plurality of fuel injector assemblies 102 bulges radially outwardly with respect to the outer surface 62 of the liner 42. As shown in FIG. 4, the second portion 72 of the flow sleeve 54 may define a plurality of inlet holes 74. During operation of the combustor 16, the inlet holes 74 provide for fluid communication between the high pressure plenum 34 (FIG. 2) and the cooling flow annulus 56 (FIG. 3). In particular embodiments, a third portion 76 of the flow sleeve 54 that is defined between a third pair of circumferentially adjacent fuel injector assemblies 102(*d*) and 102(*a*) of the plurality of fuel injector assemblies 102 bulges or protrudes radially outwardly with respect to the outer surface 62 of the liner 42. As shown in FIG. 4, the third portion 76 of the flow sleeve 54 may define a plurality of inlet holes 78. During operation of the combustor 16, the inlet holes 78 provide for fluid communication between the high pressure plenum 34 (FIG. 2) and the cooling flow annulus 56 (FIG. 3). In at least one embodiment, as shown in FIG. 4, the first portion 60 of the flow sleeve 54 may define a plurality of inlet holes 80. During operation of the combustor 16, the inlet holes 80 provide for fluid communication between the high pressure plenum 34 (FIG. 2) and the cooling flow annulus 56 (FIG. 3).

In particular embodiments, the cross sectional flow area created by the bulge along the second portion 72 of the flow sleeve 54 is equivalent to or substantially equivalent to a cross sectional area of portions of the circumferentially adjacent fuel injector assemblies 102(*b*) and 102(*c*) disposed within the cooling flow annulus 56. The second portion 72 or bulging portion of the flow sleeve 54 restores overall cross sectional flow area within the cooling flow annulus 56 that may be lost due to the size of the fuel injector assemblies 102(*b*) and 102(*c*), particularly in the same radial and/or circumferential plane as the circumferentially adjacent fuel injector assemblies 102(*b*) and 102(*c*). As a result, pressure drop within the cooling flow annulus 56 and/or between the high pressure plenum 34 and the head end volume or portion 38 of the combustor may be reduced.

In particular embodiments, the cross sectional flow area created by the bulge along the third portion 76 of the flow sleeve 54 is equivalent to or substantially equivalent to a cross sectional area of portions of the circumferentially adjacent fuel injector assemblies 102(*a*) and 102(*d*) disposed within the cooling flow annulus 56. The third portion 76 or bulging portion of the flow sleeve 54 restores overall cross sectional flow area within the cooling flow annulus 56 that may be lost due to the size of the fuel injector assemblies 102(*a*) and 102(*d*), particularly in the same radial and/or circumferential plane as the circumferentially adjacent fuel injector assemblies 102(*a*) and 102(*d*). As a result, pressure drop within the cooling flow annulus 56 and/or between the high pressure plenum 34 and the head end volume 38.

In operation, compressed air 26 from the high pressure plenum 34 enters the cooling annulus 56 via one or more of inlet holes 80, 74 and/or 78. The compressed air 26 flows or is impinged upon and/or flows across the outer surface 62 of the liner 42, thereby convectively and/or conductively cooling the liner 42. The increased cooling flow volume or area provided by the bulging portion(s) 60, 72 and/or 76 of the flow sleeve 54 reduces pressure drop typically caused by the portions of injector assemblies 102 which extend through the cooling flow annulus 56, thereby enhancing overall cooling effectiveness of the compressed air 26 within the cooling flow annulus 56.

The compressed air 26 then exits the cooling flow annulus 26 at the head end portion 38 of the combustor 16. The compressed air then mixes with fuel from the fuel nozzle 40 and is burned to form a primary combustion gas stream or main flow of the combustion gases 30 which travels through the primary combustion zone 44 to an area within the hot gas path 50 which is radially inboard of the fuel injector assemblies 102 and upstream from the inlet 52 of the turbine 18. A second fuel-air mixture is injected by the one or more fuel injector assemblies 102 and penetrates the oncoming main flow. The fuel supplied to the fuel injector assemblies 102 is combusted in the secondary combustion zone 46 before entering the turbine 18.

The embodiments of the combustor 16 described herein provide numerous advantages. For example, the additional cross sectional flow area compensates for the reduction on cross sectional area created by the fuel injector assemblies, thereby enabling higher engine firing temperatures at equivalent NOx emissions which improves overall gas turbine output and efficiency.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustor, comprising:

an annularly shaped liner at least partially defining a hot gas path of the combustor;

a flow sleeve circumferentially surrounding at least a portion of the liner, wherein the flow sleeve is radially spaced from the liner to form a cooling flow annulus therebetween; and a plurality of fuel injector assemblies circumferentially spaced about the flow sleeve, wherein each fuel injector assembly extends radially through the flow sleeve, the cooling flow annulus and the liner;

wherein a first portion of the flow sleeve defined between a first pair of circumferentially adjacent fuel injector assemblies of the plurality of fuel injector assemblies bulges radially outwardly with respect to an outer surface of the liner so as to enlarge a flow volume of the cooling flow annulus, wherein the radially outward bulge of the first portion of the flow sleeve is entirely between the first pair of circumferentially adjacent fuel injector assemblies.

2. The combustor as in claim 1, wherein the first portion of the flow sleeve defines a first plurality of inlet holes in fluid communication with the cooling flow annulus.

3. The combustor as in claim 1, wherein a second portion of the flow sleeve defined between a second pair of circumferentially adjacent fuel injector assemblies of the plurality of fuel injector assemblies bulges radially outwardly with respect to the outer surface of the liner.

4. The combustor as in claim 3, wherein the second portion of the flow sleeve defines a second plurality of inlet holes in fluid communication with the cooling flow annulus.

5. The combustor as in claim 3, wherein a third portion of the flow sleeve that is defined between a third pair of circumferentially adjacent fuel injector assemblies of the plurality of fuel injector assemblies bulges radially outwardly with respect to the outer surface of the liner.

6. The combustor as in claim 5, wherein the third portion of the flow sleeve defines a third plurality of inlet holes in fluid communication with the cooling flow annulus.

7. The combustor of claim 5, wherein a cross-sectional area of the third portion of the flow sleeve defined between the third pair of circumferentially adjacent fuel injector assemblies which bulges radially outwardly with respect to the outer surface of the liner is equivalent to a cross sectional area of portions of the third pair of circumferentially adjacent fuel injector assemblies disposed within the cooling flow annulus.

8. The combustor of claim 3, wherein a cross-sectional area of the second portion of the flow sleeve defined between the second pair of circumferentially adjacent fuel injector assemblies which bulges radially outwardly with respect to the outer surface of the liner is equivalent to a cross sectional area of portions of the second pair of circumferentially adjacent fuel injector assemblies disposed within the cooling flow annulus.

9. The combustor of claim 1, wherein a cross-sectional area of the first portion of the flow sleeve defined between the first pair of circumferentially adjacent fuel injector assemblies which bulges radially outwardly with respect to the outer surface of the liner is equivalent to a cross sectional area of portions of the first pair of circumferentially adjacent fuel injector assemblies disposed within the cooling flow annulus.

10. A gas turbine, comprising:

a compressor;

a turbine; and a combustor disposed downstream from the compressor and upstream from the turbine, the combustor comprising:

an annularly shaped liner;

a flow sleeve circumferentially surrounding at least a portion of the liner, wherein the flow sleeve is radially spaced from the liner to form a cooling flow annulus therebetween;

a plurality of fuel injector assemblies circumferentially spaced about the flow sleeve, wherein each fuel injector assembly extends radially through the flow sleeve, the cooling flow annulus and the liner; and wherein a first portion of the flow sleeve defined between a first pair of circumferentially adjacent fuel injector assemblies of the plurality of fuel injector assemblies bulges radially outwardly with respect to an outer surface of the liner so as to increase a flow volume of the cooling flow annulus, wherein the radially outward bulge of the first portion of the flow sleeve is entirely between the first pair of circumferentially adjacent fuel injector assemblies.

11. The gas turbine as in claim 10, wherein the first portion of the flow sleeve defines a first plurality of inlet holes in fluid communication with the cooling flow annulus.

12. The gas turbine as in claim 10, wherein the first portion of the flow sleeve defines a first plurality of inlet holes in fluid communication with the cooling flow annulus.

13. The gas turbine as in claim 10, wherein a second portion of the flow sleeve defined between a second pair of circumferentially adjacent fuel injector assemblies of the plurality of fuel injector assemblies bulges radially outwardly with respect to the outer surface of the liner.

14. The gas turbine as in claim 13, wherein the second portion of the flow sleeve defines a second plurality of inlet holes in fluid communication with the cooling flow annulus.

15. The gas turbine as in claim 14, wherein a third portion of the flow sleeve defined between a third pair of circumferentially adjacent fuel injector assemblies of the plurality of fuel injector assemblies bulges radially outwardly with respect to the outer surface of the liner.

16. The gas turbine as in claim 15, wherein the third portion of the flow sleeve defines a third plurality of inlet holes in fluid communication with the cooling flow annulus.

17. The gas turbine of claim 15, wherein a cross-sectional area of the third portion of the flow sleeve defined between the third pair of circumferentially adjacent fuel injector assemblies which bulges radially outwardly with respect to the outer surface of the liner is equivalent to a cross sectional area of portions of the third pair of circumferentially adjacent fuel injector assemblies disposed within the cooling flow annulus.

18. The gas turbine of claim 10, wherein a cross-sectional area of the first portion of the flow sleeve defined between the first pair of circumferentially adjacent fuel injector assemblies which bulges radially outwardly with respect to the outer surface of the liner is equivalent to a cross sectional area of portions of the first pair of circumferentially adjacent fuel injector assemblies disposed within the cooling flow annulus.

19. The gas turbine of claim 13, wherein a cross-sectional area of the second portion of the flow sleeve defined between the second pair of circumferentially adjacent fuel injector assemblies which bulges radially outwardly with respect to the outer surface of the liner is equivalent to a cross sectional area of portions of the second pair of circumferentially adjacent fuel injector assemblies disposed within the cooling flow annulus.

* * * * *